US005848671A

United States Patent [19]

Kattainen

[11] Patent Number: 5,848,671

[45] Date of Patent: Dec. 15, 1998

[54] PROCEDURE FOR STOPPING AN ELEVATOR AT A LANDING

[75] Inventor: Ari Kattainen, Hyvinkää, Finland

[73] Assignee: KONE OY, Helsinki, Finland

[21] Appl. No.: 679,143

[22] Filed: Jul. 12, 1996

[30] Foreign Application Priority Data

Jul. 14, 1995 [FI] Finland ..... 953434

[51] Int. Cl.[6] ..... B66B 1/40; B66B 1/28

[52] U.S. Cl. ..... 187/291; 187/293

[58] Field of Search ..... 187/291, 294, 187/293

[56] References Cited

U.S. PATENT DOCUMENTS

| | | | |
|---|---|---|---|
| 4,380,049 | 4/1983 | Makinen | 364/426 |
| 4,518,062 | 5/1985 | Makinen et al. | 187/291 |
| 4,789,050 | 12/1988 | Evin | 187/291 |
| 5,099,957 | 3/1992 | Eriksson | 187/291 |
| 5,421,432 | 6/1995 | Strambi et al. | 187/288 |

FOREIGN PATENT DOCUMENTS

| | | |
|---|---|---|
| 0582170 | 2/1994 | European Pat. Off. . |
| 8000324 | 3/1980 | WIPO . |

*Primary Examiner*—Robert Nappi

[57] ABSTRACT

The invention relates to a procedure for stopping an elevator car at a landing, in which procedure the travelling velocity and position of the elevator in the shaft are measured and a distance from the landing, i.e. a deceleration point at which deceleration is started, is determined for one travelling velocity, i.e. a reference velocity. According to the invention, the deceleration point is changed in proportion to the difference between the measured travelling velocity and the reference velocity.

5 Claims, 3 Drawing Sheets

PROCEDURE FOR STOPPING AN ELEVATOR AT A LANDING

Figure 1:
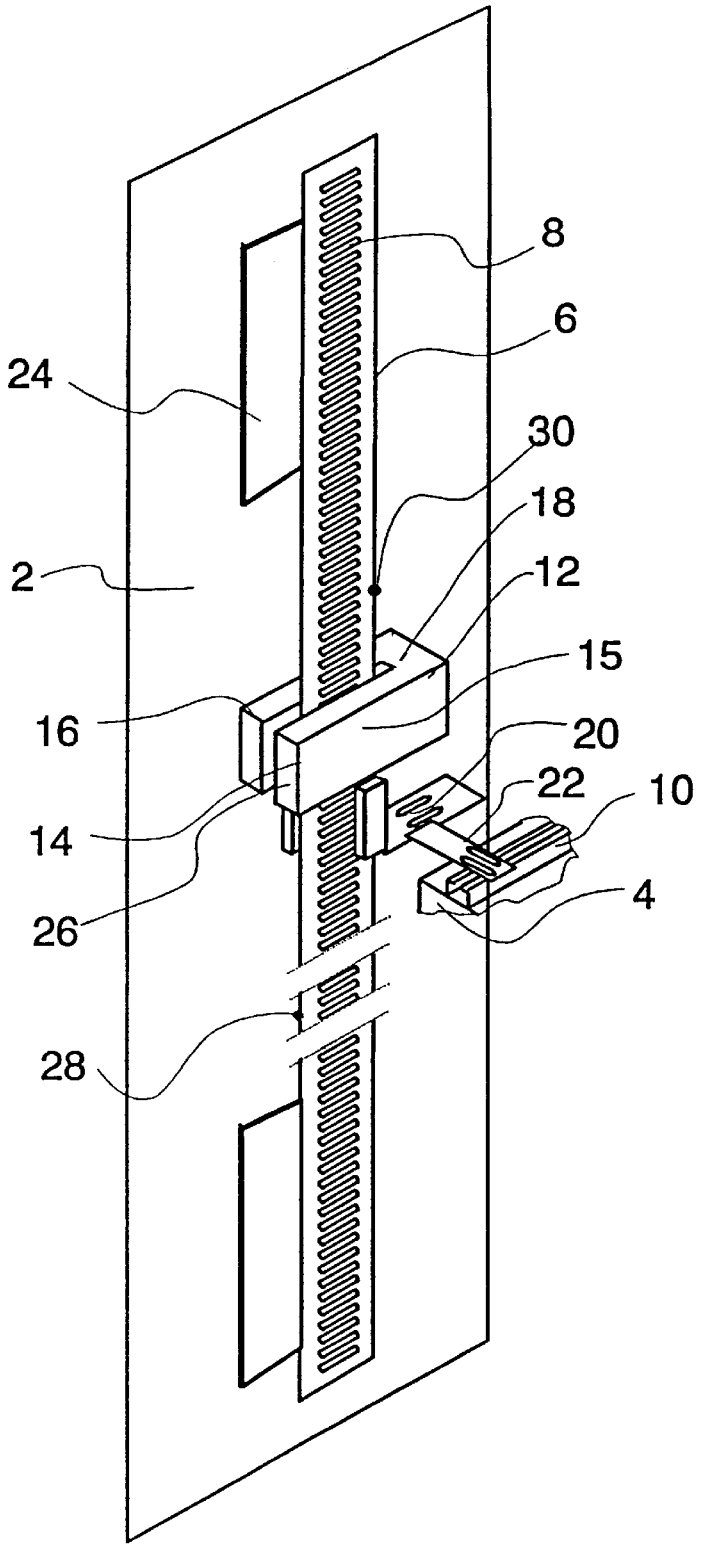

The present invention relates to a procedure for decelerating an elevator by determining the proper point, in an elevator shaft, at which the elevator should begin deceleration.

An important aim in the control of an elevator drive is to ensure that, when the elevator comes to a standstill, the floor of the elevator car is as closely as possible at the same level with the landing floor. Advanced elevator control systems employ distance and speed feedback to bring the elevator to the landing. Similarly, the speed curve of the elevator car is optimized by adjusting the values of velocity, acceleration and change of acceleration in advance or during operation. In addition to complicated control equipment, these systems also require accurate and fast measuring apparatus to achieve the results aimed at.

Elevator drives used in low-rise buildings, where the elevators travel at low speeds, are generally simple and without a full regulation capability. In such elevators, e.g. one-speed or two-speed squirrel cage motor drives or motor drives controlled by simple regulators are used. As there is no speed feedback to the motor available, previously known solutions employ various ways to approximate the motor behaviour.

Specification EP A1 582 170 (KONE Elevator GmbH) presents a prior-art solution based on the change occurring in the slip of a squirrel cage motor due to the load. The onset of deceleration is delayed depending on how much lower the car speed is than the car speed when the elevator is being driven in the up direction with an empty car or in the down direction with a full car, which represents the lightest load situation. The elevator control system reacts to the signal requiring the elevator to stop at a landing by measuring the speed of the elevator car and comparing the measured speed with the car speed corresponding to the highest possible speed and delaying the onset of deceleration until the measured speed and the deceleration curve defined for the elevator intersect, at which point deceleration is started in accordance with a constant deceleration curve. Changes in the properties of the equipment are taken into account by changing the deceleration. By contrast, variations in normal operating conditions are not considered, but the same deceleration value is always used. Variations in operating or environmental conditions cause errors in the control of levelling the car with the landing. In this case, in consequence of a slight overload, the elevator speed exceeds the highest or is below the lowest design speed. Furthermore, an exceptionally abnormal load may produce changes in the friction between the guide rails and the guides. Changes in the variation of the operating voltage affect the operating point, with the result that the slip and the torque differ from the calculated values.

The object of the present invention is to achieve a new solution for controlling the levelling of an elevator car with a landing that eliminates the drawbacks present in earlier solutions. The invention is based on the observation that the speed of an elevator car is different when the elevator is operated in different load conditions and, in addition, that the deceleration and stopping distances are different in different load conditions. Furthermore, it has been established that a substantially linear dependence prevails between elevator speed and deceleration and stopping distance. The procedure of the invention is characterized by changing the deceleration starting point in proportion to the difference between the travelling velocity of the elevator car and a reference velocity.

When the solution of the invention is applied, the creeping distance of the elevator is considerably shorter than before and the performance of the elevator is improved. The levelling accuracy of the elevator is also improved. The quantity to be measured and monitored is the movement of the car itself in the elevator shaft, which is also influenced by controlled variables. Therefore, changes in the operating conditions affect both the reference values and the controlled variables in the same way, with the result that the total error produced by the changes will be as small as possible, without the need to monitor and consider each factor separately. For instance, an increase in the friction produces a decrease in the speed and a corresponding decrease in the stopping distance. The cause of the change is "included" in both with equal value, so its effect will be taken into account. In other words the feedback loop consists of the car, the ropes, the traction sheave, the motor, the control unit of the motor and the car speed measuring arrangement.

Readjustment of levelling is easy to perform and requires no complicated equipment. The procedure can be applied to drives of different types because the controlling variable is outside the rest of the control system.

Figure 2:
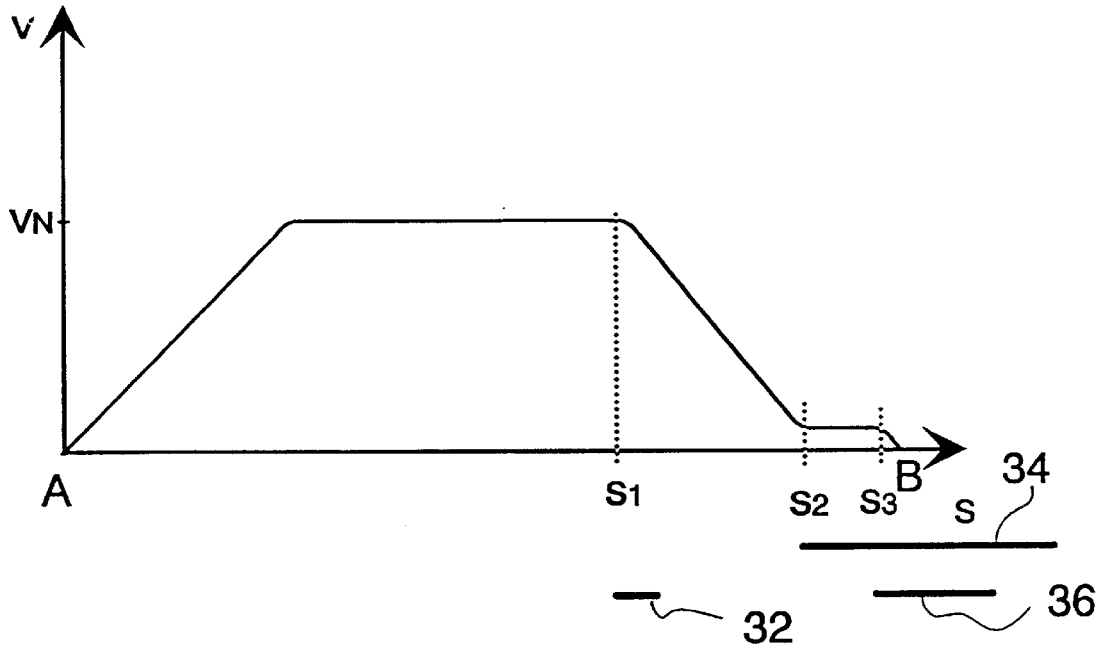
Figure 3:
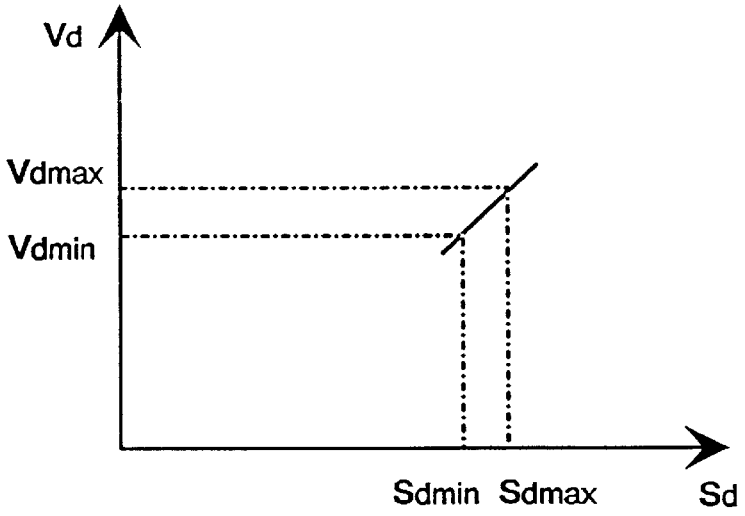
Figure 4:
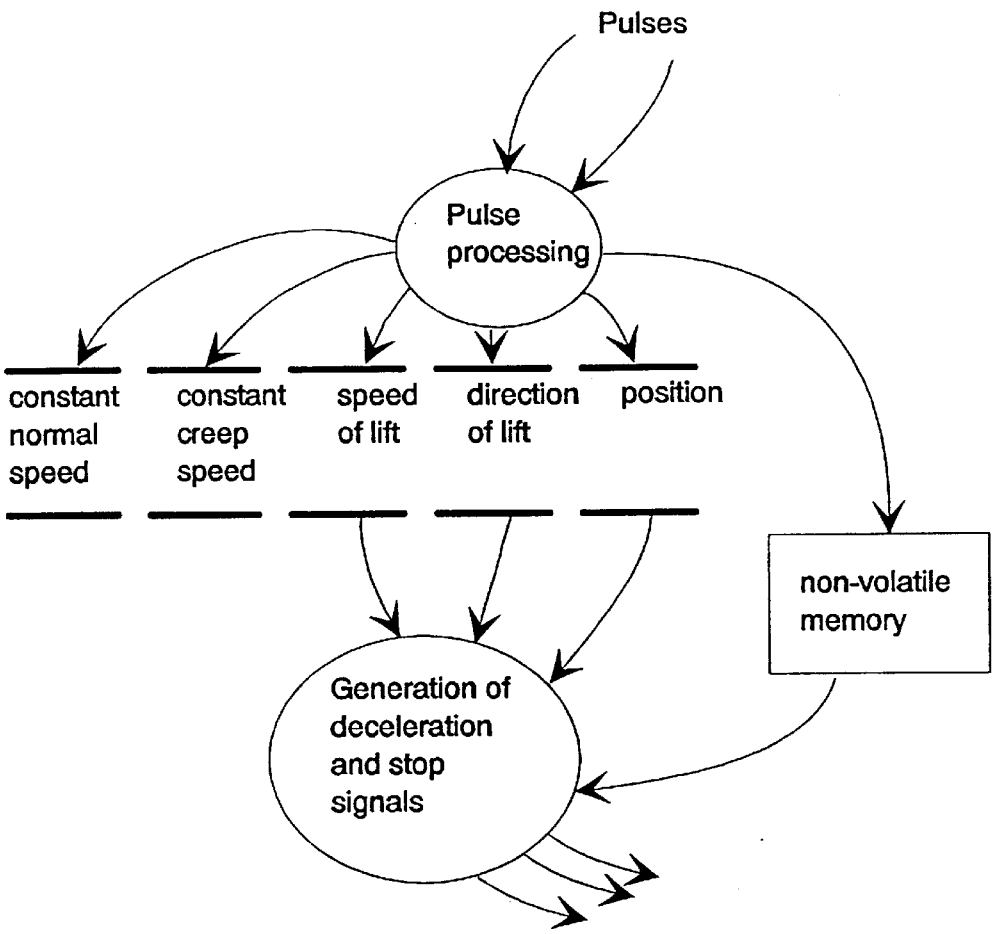
Figure 5:
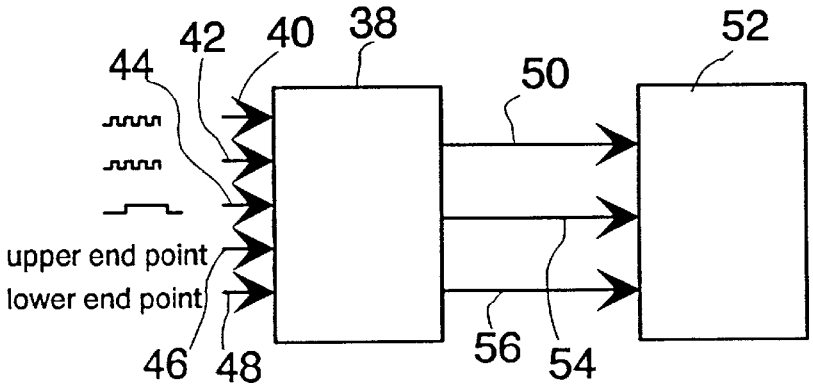

In the following, the invention is described by the aid of a few embodiments by referring to the drawings, in which FIG. 1 presents shaft equipment as provided by the invention, FIG. 2 presents a curve representing the travel of an elevator, FIG. 3 represents the dependence of elevator deceleration on the speed/distance, FIG. 4 presents a status diagram, FIG. 5 represents a control system.

FIG. 1 presents part of the shaft equipment installed in the elevator shaft, showing only the equipment required for the description of the present invention. For the determination of the position and speed of the elevator car 4, a perforated tape 6 with perforations at regular intervals is mounted in the elevator shaft 2. It is also possible to use some other kind of tape with corresponding markings at regular intervals throughout the length of the elevator shaft. The perforated tape 6 is made of metal and attached to the shaft walls at least in the upper and lower parts of the shaft. Mounted on a supporting structure of the car on the top of the elevator car is a reader device 12 fitted to travel along the perforated tape throughout the length of the shaft. In practical applications of the present invention, the reader device may also be placed in a different location on the car.

The reader device 12 consists of a U-shaped structure with its two legs 14 and 16 fitted to extend across each broad side of the perforated tape. The reader device 12 is fixed by the base part 18 of the U-shaped structure to a frame 20 joined with fixing devices 22 to a supporting structure 10 of the car. Mounted on leg 14 of the reader device is a read head 15 designed to detect the perforations 8 in the perforated tape when the car is moving in the shaft. The read head 15 is e.g. optically implemented and it provides an output consisting of a pulse train in which each pulse interval corresponds to the distance between two perforations in the shaft. The output of the reader device 12 is passed to the elevator control system, to be processed in a manner described later on.

Attached to the edge of the perforated tape are door zone strips 24 for each landing. The reading device is provided with door zone detectors 26 placed in corresponding locations. When the car arrives at a door zone, a pulse signal representing door zone information is transmitted to the elevator control system. The perforated tape 6 is provided with positive deceleration switches 28 and 30 mounted at a distance from the top and bottom of the shaft, respectively. The switches 28 and 30 are implemented as magnets which are detected by a corresponding detector in the reader device and induce a signal in the positive deceleration input of the reader device. When a positive deceleration signal is switched on, the elevator control system begins to decelerate the elevator to stop it at the bottom floor or the top floor, respectively.

FIG. 2 depicts the elevator speed as a function of distance when the elevator drives from floor A to floor B. The figure also shows where the marks used for deceleration and stopping control of the elevator are placed on the path of the car. After acceleration, the elevator drives at a constant velocity $V_n$, until the elevator control system produces a so-called pick-up signal at point $S_1$. Through the deceleration distance $S_d$, the elevator is retarded with constant deceleration until reaching point $S_2$, where the creeping distance $S_c$ begins. At point $S_3$, levelling is started, the elevator car being retarded through the stopping distance $S_s$ down to zero speed at floor B. Below the distance axis in FIG. 2, the signals controlling the stopping of the elevator, the pick-up signal 32, the levelling start signal 34 and door zone signal 36, are also indicated.

When an elevator is put into operation, it is customary to perform a so-called set-up drive, during which the elevator is driven at normal speed from end to end of the shaft. Deceleration is started by the positive deceleration switches 28 and 30. During this drive, the locations of the door zones are stored in memory. The deceleration distance of the elevator from the positive deceleration switch to the creep velocity or stopping is measured using pulse signals and stored in memory. FIG. 4 shows a status diagram for the determination of speed and position and generation of deceleration and stop signals, while FIG. 5 presents corresponding hardware. The output signals from the reader device are applied to the inputs 40 and 42 of a stopping control unit 38. From the pulse signals, this unit determines the velocity and position of the elevator. The door zone signal is applied to input 44 of unit 38. The positive deceleration signals from switches 28 and 30 are applied to inputs 46 and 48, respectively. In addition to determining the elevator's speed and position, the stopping control unit also establishes the travelling direction from the pulses and determines whether the elevator has reached the normal steady travelling speed or the steady creeping speed. The locations of the door zones are stored in 30 a memory provided in unit 38.

After the set-up drive, there follows a teach-in drive during which the elevator is driven up and down with an empty car so that the elevator reaches the normal travelling speed. In the case of an elevator with a counterweight, driving down with an empty car corresponds to the heaviest load on the motor, and driving up with an empty car corresponds to the lightest load. The elevator speed changes accordingly, in other words, when the elevator is driven in the down direction with an empty car, the speed is lowest, and highest when it is driven in the up direction. When a squirrel cage motor is used, the former case corresponds to a situation where the slip is largest and the latter to a situation where the motor is working in generator mode, i.e. the slip is negative. During the teach-in drive, the deceleration and stopping distances are measured. FIG. 3 illustrates the dependence of the deceleration distance on the steady travelling speed when the elevator is decelerated from the travelling speed to zero speed with constant deceleration. Accordingly, the minimum velocity $V_{dmin}$ corresponds to deceleration distance $S_{dmin}$ and the maximum velocity $V_{dmax}$ to deceleration distance $S_{dmax}$. In a corresponding manner, we also obtain velocity-distance dependencies for stopping velocity and stopping distance when the elevator is stopped from the steady creeping speed to zero speed. For the constant travelling speed $V_d$, from which the deceleration is started, the distance $S_d$ required for stopping is calculated, using variable designations as in FIG. 3, from the formula $$S_d=S_{dmin}+(V_d-V_{dmin})*(S_{dmax}-S_{dmin})/(V_{dmax}-V_{dmin}), \quad (1)$$

where the distance required for stopping is larger than the distance $S_{dmin}$ required at the minimum speed $V_{dmin}$. The difference between the distances is proportional to the difference between the travelling speed $V_d$ and the minimum speed used as a reference velocity as well as to the coefficient of proportionality $\Delta s$, which is obtained as the ratio of the minimum and maximum velocities and the differences between the corresponding stopping distances. The minimum velocity corresponds to the speed when driving in the heaviest direction, and the maximum velocity to the speed when driving in the lightest direction. The application of the procedure is not restricted to these velocities, but the velocity may also be outside these limits. Similarly, a reference speed and, correspondingly, a coefficient of proportionality can be defined for other velocities as well.

During normal operation, the velocity and position of the elevator are determined continuously by reading the perforated tape and counting the numbers of pulses read. Once the constant speed $V_d$ has been reached, the distance $S_{tot}$ of the deceleration onset point from the floor is determined $$S_{tot}=S_d+S_c+S_s \quad (2)$$

where $s_d$ = deceleration distance

= $s_{dmin} + (v_d - v_{dmin}) * (s_{dmax} - s_{dmin})/(v_{dmax} - v_{dmin})$, $s_c$ = creeping distance = a constant distance specific to each elevator drive, $s_s$ = stopping distance = $s_{smin} + (v_c - v_{smin}) * (s_{smax} - s_{smin})/(v_{smax} - v_{smin})$, and $v_c$ = creeping velocity When the deceleration control unit detects that the deceleration point defined above has been reached, the deceleration unit generates a pick-up signal 50 to the elevator control system 52 and, correspondingly, when the elevator reaches the stopping point $S_3$ (FIG. 2), stop signals up 54 and down 56, depending on the travelling direction.

When a single-speed motor is used and the elevator is not moving at creeping speed, only the deceleration distance $S_d$ is calculated, in which case equation (1) is used.

For floor-to-floor distances where the normal travelling speed is not reached, specific teach-in drives are performed. In this case, the deceleration point is so adjusted that a suitable creeping distance is obtained for the light direction. The same distance is also applied for the heavy direction.

The invention has been described in the foregoing by the aid of a few examples of its embodiments. However, the presentation is not to be regarded as constituting a limitation of the sphere of patent protection, but the implementations of the invention may vary within the limits defined by the claims.

I claim:

1. A method for stopping an elevator car at a landing, comprising measuring the current travelling velocity of the elevator car and its position in the shaft, and calculating the deceleration distance from a destination landing to the deceleration point from which deceleration is started based upon the current travelling velocity of the elevator car and a reference velocity, and, when the elevator reaches the calculated deceleration point, issuing a stopping signal regardless of the time at which such stopping signal would have been issued had the elevator been travelling at the reference velocity, wherein said calculating step also considers a reference deceleration distance corresponding to the reference velocity, the reference deceleration distance being determined by the steps of:

driving an elevator car at the reference velocity in one of the up and down directions;

detecting when the elevator car passes a deceleration switch mounted at a predetermined position within the elevator shaft; and measuring the deceleration distance traveled by the elevator car as the car speed decreases from the reference velocity to zero velocity, wherein exactly two deceleration switches are mounted within the elevator shaft, the deceleration switches being used for determining respective up and down reference deceleration distances corresponding to the reference velocity.

2. The method as defined in claim 1, wherein the reference velocity and the corresponding deceleration point are determined during a preliminary drive with the elevator, which comprises driving with an empty elevator car in the up direction, and measuring the deceleration distance travelled by the elevator as the car speed decreases from the reference velocity to zero velocity, and storing the reference velocity and the corresponding deceleration point in memory.

3. The method as defined in claim 1, wherein the deceleration point is changed by adding to the deceleration distance corresponding to the reference velocity the product of a coefficient of proportionality and the difference between the travelling velocity and the reference velocity, said coefficient of proportionality being determined from the formula $\Delta S=(S_{dmax}-S_{dmin}) / (V_{dmax}-V_{dmin})$, where $V_{dmax}$=highest possible velocity, $V_{dmin}$=lowest possible velocity, $S_{dmax}$=deceleration distance for the highest possible velocity, $S_{dmin}$=deceleration distance for the lowest possible velocity, and further wherein the coefficient of proportionality is stored in memory.

4. The method as defined in claim 2, wherein the velocity of the elevator car is measured continuously and when the elevator control system suggests that the elevator be stopped, the coefficient of proportionality and the reference velocity are read from memory and the deceleration point is computed from the formula $S_d=S_{dmin}+\Delta S_d^* (V_d-V_{dmin})$, where $V_d$=the velocity at the start of deceleration, and when the elevator car reaches the deceleration point, a deceleration command is issued.

5. A method for stopping an elevator car at a landing, comprising measuring the current travelling velocity of the elevator car and its position in the shaft, and calculating the deceleration distance from a destination landing to the deceleration point from which deceleration is started based upon the current travelling velocity of the elevator car and a reference velocity, and, when the elevator reaches the calculated deceleration point, issuing a stopping signal regardless of the time at which such stopping signal would have been issued had the elevator been travelling at the reference velocity, wherein said calculating step also considers a reference deceleration distance corresponding to the reference velocity, the reference deceleration distance being determined by the steps of:

driving an elevator car at the reference velocity in one of the up and down directions;

detecting when the elevator car passes a deceleration switch mounted at a predetermined position within the elevator shaft; and measuring the deceleration distance traveled by the elevator car as the car speed decreases from the reference velocity to zero velocity, wherein the deceleration switch is a magnet mounted on a tape, the tape extending over a plurality of floors within the elevator shaft.

* * * * *